United States Patent [19]

Skinner et al.

[11] 4,262,705

[45] Apr. 21, 1981

[54] INTERNAL SUPPORT STRUCTURE FOR HEAT EXCHANGER

[75] Inventors: David R. Skinner, Georgetown; Lawrence L. Bethel, Boston; Ralph S. Clemens, Georgetown, all of Mass.

[73] Assignee: General Electric Company, Lynn, Mass.

[21] Appl. No.: 38,659

[22] Filed: May 14, 1979

[51] Int. Cl.[3] ..... F16L 59/12

[52] U.S. Cl. ..... 138/149; 138/108; 138/172

[58] Field of Search ..... 138/108, 103, 149, 172, 138/178; 52/645, 693

[56] References Cited

U.S. PATENT DOCUMENTS

| | | | |
|---|---|---|---|
| 279,392 | 6/1883 | Johnstone | 138/108 |
| 3,202,184 | 8/1965 | Godshalk | 138/172 |
| 3,557,838 | 1/1971 | Savage | 138/108 |
| 3,776,253 | 12/1973 | Yamaguchi et al. | 138/108 |

*Primary Examiner*—James E. Bryant, III

*Attorney, Agent, or Firm*—James W. Mitchell

[57] ABSTRACT

In a hot gas duct wherein it is desirable to retain heat within the duct by insulated sidewalls and wherein the duct is substantially longer than it is wide, it is necessary to support the duct against excessive deformation in the lateral direction. Exterior support structures are unacceptable because locating cross members or struts becomes problematic. Interior support structures must be carefully designed so as not to inhibit thermal expansion and contraction within the duct. It is proposed that a lateral bracing system or truss be disposed entirely inside the hot gas path and provision be made to ensure adequate facility for uniform expansion of the truss within the hot gas duct.

10 Claims, 4 Drawing Figures

INTERNAL SUPPORT STRUCTURE FOR HEAT EXCHANGER

BACKGROUND OF THE INVENTION

This invention generally relates to a structural support for a hot gas duct and particularly relates to a novel construction of a support system for a modular heat exchanger of the type suitable as a steam generator for a steam power plant.

Power plants may include steam generators to produce motive fluid for driving steam turbines. One type of steam generator is known as a heat recovery steam generator (HRSG) and is employed in combined cycle power plants wherein hot exhaust gases from a gas turbine are passed in a non-contact heat exchange relation with feedwater to provide steam for a steam turbine thereby recovering otherwise wasted heat from the gas turbine exhaust.

The heat recovery steam generator may be made in sectionalized form by stacking modules, which include heat exchange tubes, one on top of the other to define a substantially vertical hot gas path. Fluid carrying tubes are disposed lengthwise across the heat exchange module and are supported by tube support plates. As the exhaust gas rises in the heat exchanger it loses heat in the heat exchange process. Similarly, as the feedwater passes downwardly in the hot exhaust gas path it turns to steam and then becomes superheated. Hence the heat exchange process is a counter-flow heat exchange process. Each sectional module is usually rectangular in form with the tube bundles running along the length of the rectangle. This provides maximum exposure of the tubes to the hot gas within the heat exchanger steam generator. Since the HRSG is of considerable length, lateral support is necessary along the length of the module to protect against wind loads and other forces which could cause lateral deformation.

One approach to lateral strengthening of the HRSG module is to provide cross members (relative to the gas flow path) attached at discrete points to the external sidewalls of the box. The sidewalls thus function as the lengthwise members. However, since the cross members must necessarily be located in the hot gas path in the type of construction under discussion the strengthening network would then consist of hot and cold members which would cause excessive lateral thermal deformation and/or locked in thermal loads. Lengthwise bracing of the exterior of the HRSG is likely to be insufficient unless tied to cross members. The problem thus presented is not believed to have found solution in the prior art.

OBJECTS OF THE INVENTION

It is one object of the invention to provide a lateral bracing support for a heat exchange module.

It is another object of the invention to provide a lateral bracing support which will respond satisfactorily to thermal expansion as well as lateral loads.

It is another object of the invention to provide a lateral bracing support which does not increase the overall box dimensions of the heat exchange module.

It is another object of the present invention to provide a lateral bracing support which will provide for equal relative thermal expansion at both box ends.

Finally, it is another object of the invention to provide a lateral bracing support which is positioned to minimize thermal stress within the box.

The novel features believed characteristic of the present invention are set forth in the appended claims. The invention itself, however, together with further objects and advantages thereof, may best be understood with reference to the following description taken in connection with the drawings.

BRIEF DESCRIPTION OF THE INVENTION

The invention relates to the lateral support of a heat exchanger apparatus wherein the apparatus provides a site for a non-contact heat exchange process between hot gases and feedwater, the latter being circulated through the apparatus in tube bundles. The heat exchange apparatus may be comprised of large rectangular modules which are stacked together and opened at each end in the direction of gas flow.

The lateral support is provided in the form of a truss which is located within the hot gas path. The truss is comprised of a pair of parallel rails which are slidably fastened to either side of the rectangular module and extend along the length of the box. The rails also support a plurality of cross members which intersect at a plurality of gusset plates. The assembly allows the box to expand in the axial direction while providing lateral supports as shall be described.

DETAILED DESCRIPTION OF THE INVENTION

One type of steam generator suitable for power plant use is a heat recovery steam generator (HRSG). In the context of a combined cycle power plant, the HRSG becomes a thermal connecting link between a gas turbine and a steam turbine. Hot gas turbine exhaust gas is passed in a non-contact counterflow heat exchange relation with steam turbine feedwater in order to provide steam for the steam turbine portion of the power plant thereby utilizing the waste heat in the gas turbine exhaust. One example of such a plant is shown in U.S. Pat. No. 3,934,553 issued Jan. 27, 1976 to Freeman et al and assigned to the assignee of the present invention.

Figure 1:
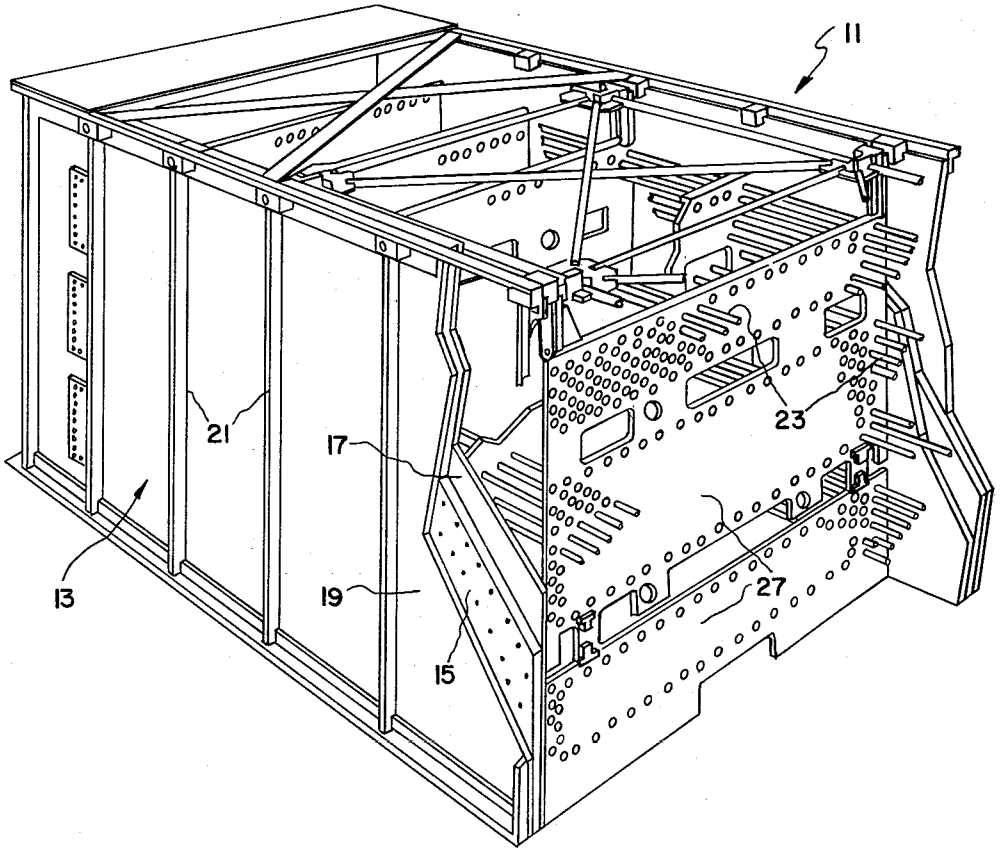
FIG. 1 is an isometric, cutaway view of a heat exchange module in accordance with the present invention.

The HRSG may be comprised of stacked steam generator modules which provide a hot gas duct. One such steam generator module or box 11 is illustrated in FIG. 1. The hot gas duct is defined by a rectangular perimeter which is comprised of erect sidewalls 13. The sidewalls may be formed with heat insulating material 15 encapsulated between inner and outer sheet metal coverings 17 and 19 respectively, and finally stiffening ribs 21 may be regularly spaced along the sidewalls. This construction will prevail around the entire perimeter of the steam generator box although the entire structure is not shown in detail in FIG. 1.

As is more fully illustrated in a co-pending companion case Ser. No. 034,377 assigned to the assignee of the present invention each module may include a plurality of fluid (water/steam) carrying tubes 23. Each section of tubes may be considered a tube bundle. The tube bundle may be defined as a tube section tied together by a common inlet and outlet header not shown in the present illustration and not particularly germane to the present invention except by way of illustration. The tube bundles are supported within the module by means of so-called tube support plates 27. The structure of a tube bundle is illustrated in the same co-pending patent application Ser. No. 034,377.

A HRSG may include several modular heat exchange boxes. These boxes may then define such sections known as the heater, economizer, evaporator and superheater sections, although two or more sections may be included in one box. These sections are familiar to those having ordinary skill in the art. The boxes are stacked vertically to define a hot gas path wherein the gases lose their heat to the fluid carrying tubes in a non-contact counterflow heat exchange relation. In each section the gas temperature is cooler at the exit portion of the box than at the entrance portion of the box in the direction of gas flow due to the heat exchange with the tube fluid.

Figure 2:
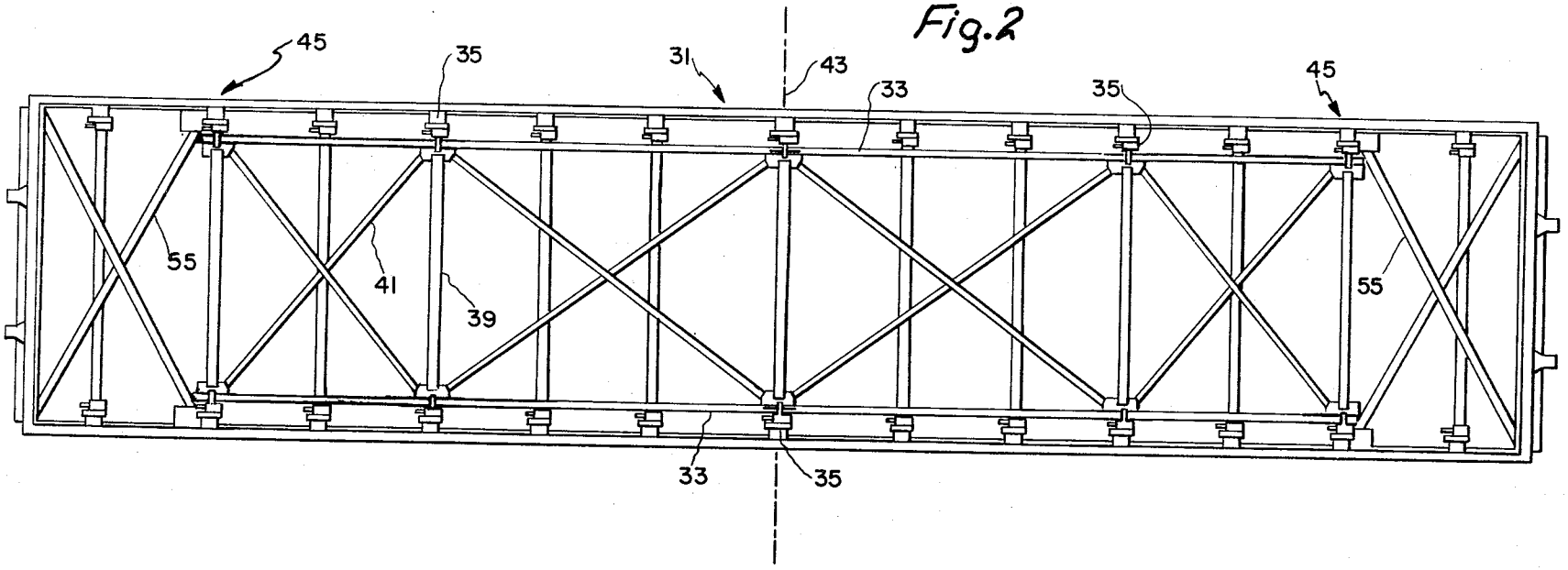
FIG. 2 is a plan view of a heat exchange module indicating the truss system according to the invention.

Referring now to FIG. 2, which shows a centerline plan view at the upper portion of the module and in conjunction with the detail drawing of FIG. 1, an internal truss system 31 is shown for providing lateral stiffening to the HRSG box. Noting that the box is considerably longer than it is wide there is a potential for excessive lateral deformation if no lateral support is provided. Moreover, it is clear that any lateral support to be provided must include cross members. Obviously this involves some interaction with the hot gas path. Thermal considerations preclude a combination of cold lengthwise supports and hot cross supports and hence, it is one aspect of the present invention to include the entire lateral support structure in the hot gas path. Coincidently, the same thermal consideration preclude rigid connections at certain points which will be discussed in the following details.

Figure 3:
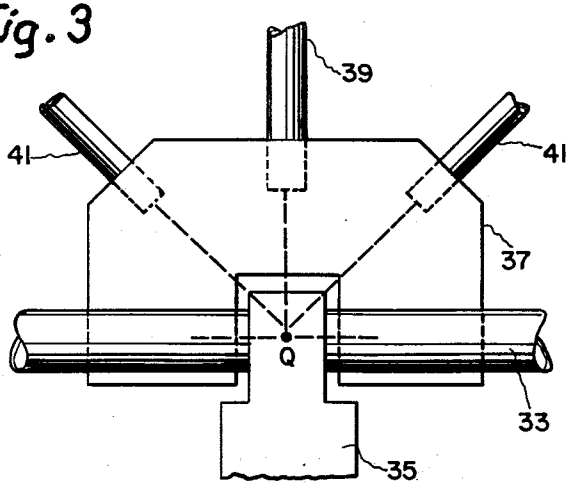
FIG. 3 is an isolated view of a typical gusset connection point.

Two parallel base rails 33 extend in the lengthwise direction of the box. The rails are generally slidable with respect to support points on either sidewall. At selected points along the length of the box there are eye supports 35 through which the rails are threaded on each side of the box. The eye supports are fixed relative to the sidewalls and so the sidewalls and rails are slidable relative to one another. A typical eye support is shown in the isolation view in plan at FIG. 3.

Each support point and eye support is coordinated with a gusset plate 37. The gusset plate is attached to the side rail through slots and provides the connection for cross members. The cross members include straight members 39 and diagonal members 41. When loaded the force lines acting through the members intersect at point Q which then enables the forces to be resolved into right angle components. This is another aspect of the present invention.

Figure 4:
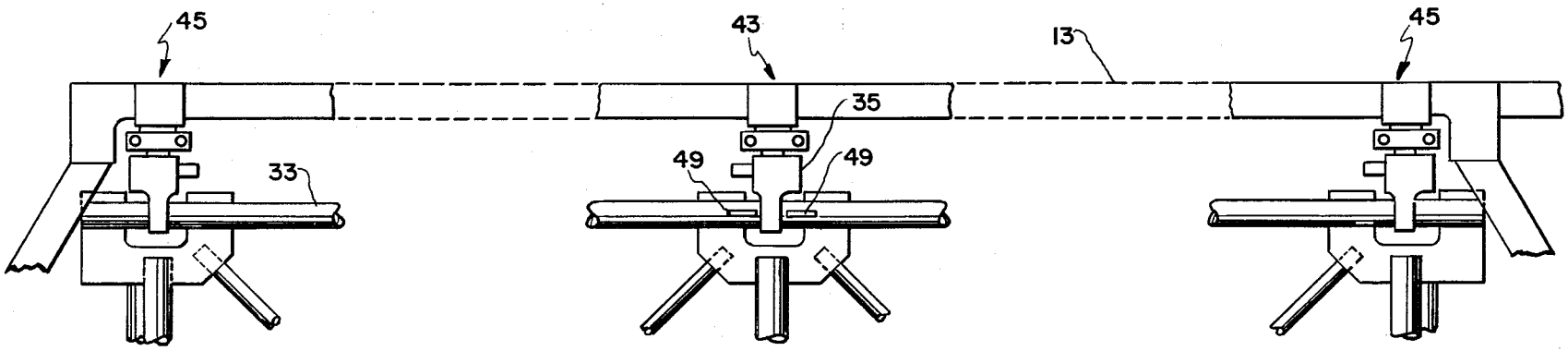
FIG. 4 is a plan view of a centerline joint and two end joints.

One embodiment of the present invention is shown in FIGS. 2 and 4 taken in combination to illustrate the centerline support 43 and two end supports 45 of the sliding lateral support system. As previously described, the box module may include a number of support points generally located at the rib stiffeners 21. In all instances these support points are used to support depending tube support plates 27. At other selected support points, both the tube support plates and the sliding truss members (including rails 33 and gusset members 37) are supported. At the centerline support 43, stops 49 are provided on each side of the eye support 35 to restrain thermal expansion at the centerline of the support so that thermal expansion occurs equally in both directions from the centerline support. At each end support 45 of the slidable truss, the lines of action of members 39 and 41 will pass through the eye support as previously described in connection with FIG. 3.

The load through the supports is then transferred to the ends of the box through a stationary truss including cross members 55 at each end of the box. Each stationary truss is attached at discrete points to the box exterior walls. The truss attachment points occur at the vertices of the diagonal members and connection to the exterior is by means of a sliding mechanism which allows axial expansion of the hot truss relative to the cooler box exterior walls. The internal sliding truss system stops short of the ends of the box at which point it transfers loads to the stationary truss at each end of the box also internal to the box. Primary truss members are designed for tensile and compressive loads. Diagonal members carry tensile loads only and are disconnected at their intersection so relative deflection can freely occur. The connections at the centerline of the box on both sides are rigid, thus relative axial thermal growth of the truss to the box exterior is equalized from end to end. The line of action mismatch between truss and load points is thus minimized.

All other connections between the truss and the box exterior allow axial slippage while maintaining lateral and vertical continuity. The last diagonal members of the truss system are fixed into the box exterior at the corner of the end wall or at the end of the hot gas path and at the end of the sliding internal truss. This arrangement permits more accurate location of truss loading into the end wall than was obtainable by extending the sliding truss to the end wall. The stationary truss members are functionally similar to the other diagonal members in that they carry only tensile loads and are disconnected at the middle to allow the brace in compression to freely deflect.

The truss is located at the top of each module box and connected at a discrete number of points so that the temperature of external hot spots and heat flow to the box exterior are minimized. Additional parallel trusses within a given module may be utilized. Each truss lies entirely within the box thus maximizing the stiffness without affecting overall box exterior dimensions. All members of the truss are at identical temperatures and are made from similar materials so uniform thermal expansion will occur without distortion of thermal distress. Member sizes are selected to give equal heating rates to minimize transient thermal distortion and stresses.

While there has been shown what is considered to be the preferred embodiment of the present invention, other modifications may occur to those skilled in the art; and, it is intended to cover in the appended claims all such modifications as fall within the true spirit and scope of the invention. Such modifications include variations in the numbers of truss sections and the spacing between connection points.

What is claimed is:

1. In a rectangular hot gas duct having a length dimension which exceeds a width dimension, said length dimension comprising two opposing sidewalls and said width dimension comprising two opposing duct end walls; an improved support structure for said duct wherein the improvement comprises:

a sliding truss structure mounted across said hot gas duct;

support means mounted on each of said two opposing sidewalls, said sliding truss structure being slidably mounted on said support means whereby the truss structure is free to expand in the lengthwise direction; and, stationary trusses at each end of the sliding truss member fixed between the duct sidewalls and the duct end walls.

2. The support structure recited in claim 1 wherein the support means includes a plurality of eye members aligned on each opposite sidewall.

3. The support structure recited in claim 1 wherein the slidable truss structure includes a pair of opposite base rails, each slidably mounted to the support means on either adjacent sidewall of the hot gas duct.

4. The support structure recited in claim 3 wherein the slidable truss structure includes:

a plurality of diagonal and perpendicular cross members; gusset plates at selected cross member vertices for tying said cross members to said base rails.

5. The support structure recited in claim 1 further comprising stop means adjacent the sliding truss structure centerline whereby axial thermal expansion occurs equally in both directions.

6. In a rectangular hot gas duct having a length and a width including heat insulated opposite sidewalls extending along the length of the duct and heat insulated end walls across the width of the duct; an improved support structure for said duct wherein the improvement comprises:

a sliding truss structure mounted in the hot gas duct across the hot gas path, the sliding truss structure including a pair of parallel rails interconnected by cross members extending across the hot gas path;

support means mounted on each of said two opposing sidewalls, said parallel rails being mounted to said support means whereby the slidable truss structure may expand in the lengthwise direction; and, stationary trusses at each end of the sliding truss members and fixed between the duct sidewalls and the duct end walls.

7. The support structure recited in claim 6 further comprising gusset plates for connecting the cross members to the parallel rails, said cross members being arranged so that the lines of force acting through the members pass through a single point to be resolved into right angle components.

8. The support structure recited in claim 6 wherein the sliding truss and the stationary trusses are located at a downstream portion of the duct with respect to the direction of the hot gas flow.

9. In a rectangular hot gas duct wherein the duct includes spaced apart heat insulated sidewalls in the lengthwise direction interconnected by a pair of heat insulated spaced apart end walls defining a hot gas path; an improved support structure for said duct, the improvement comprising:

a plurality of eye support members aligned and spaced along the length of each opposite sidewall;

a sliding truss mounted in the hot gas path, the sliding truss including a pair of opposite substantially parallel base rails extending lengthwise in the duct, said base rails being slidably mounted through eye support members on adjacent lengthwise sidewalls;

gusset plates each located at an eye support member and connected to a base rail portion at that eye support member; and, cross members connected at opposite ends to gusset plates whereby the opposite base rails are tied together across the hot exhaust gas duct.

10. The support structure recited in claim 9 further including a stationary truss at each end of the hot gas duct each having one end adjacent the end of the sliding truss and having an opposite end anchored to a duct end wall.

* * * * *